US008976977B2

(12) United States Patent
De Sena et al.

(10) Patent No.: US 8,976,977 B2
(45) Date of Patent: Mar. 10, 2015

(54) MICROPHONE ARRAY

(75) Inventors: Enzo De Sena, London (GB); Hüseyin Hacihabiboğlu, Guildford (GB); Zoran Cvetković, London (GB)

(73) Assignee: King's College London, London (GB)

( * ) Notice: Subject to any disclaimer, the term of this patent is extended or adjusted under 35 U.S.C. 154(b) by 560 days.

(21) Appl. No.: 12/905,415

(22) Filed: Oct. 15, 2010

(65) Prior Publication Data

US 2012/0093337 A1 Apr. 19, 2012

(51) Int. Cl.
*H04R 3/00* (2006.01)

(52) U.S. Cl.
CPC ..... *H04R 3/005* (2013.01); *H04R 2201/401* (2013.01); *H04R 2430/21* (2013.01); *H04S 2400/15* (2013.01)
USPC ..... 381/92; 381/26; 381/17

(58) Field of Classification Search
USPC ..... 381/26, 92, 313, 17, 356
See application file for complete search history.

(56) References Cited

U.S. PATENT DOCUMENTS

| | | | | |
|---|---|---|---|---|
| 6,173,059 | B1 * | 1/2001 | Huang et al. | 381/92 |
| RE38,350 | E * | 12/2003 | Godfrey | 381/92 |
| 6,845,163 | B1 | 1/2005 | Johnston et al. | |
| 7,149,315 | B2 * | 12/2006 | Johnston et al. | 381/92 |
| 2011/0142253 | A1 * | 6/2011 | Hata et al. | 381/92 |

FOREIGN PATENT DOCUMENTS

WO WO 2010021154 A1 * 2/2010

OTHER PUBLICATIONS

Hulsebos, Edo, Thomas Schuurmans, Diemer de Vries, and Rinus Boone. "Circular microphone array for discrete." Journal of the Audio Engineering Society (2003). Web. <http://www.aes.org/tmpFiles/elib/20121113/12596.pdf>.*
West, James R. "Chapter 3: IID-based Panning Methods." Five-Channel Panning Laws. University of Miami, 1998. Web.*
Griesinger, David. "Stereo and Surround Panning in Practice." Journal of the Audio Engineering Society (2002). Web.*
Stereophony, Franssen, Philips Technical Library, pp. 1-85, 1964.
Ambisonics in Multichannel Broadcasting and Video, Gerzon, J. Audio Eng. Soc., vol. 33, No. 11, pp. 859-871, Nov. 1985.
(Continued)

*Primary Examiner* — Joseph Saunders, Jr.
*Assistant Examiner* — James Mooney
(74) *Attorney, Agent, or Firm* — Carmody Torrance Sandak & Hennessey LLP

(57) ABSTRACT

A microphone array, comprising N microphones, wherein N is greater than or equal to 3 is provided. The microphones are substantially equiangularly arranged over a circular arc subtending an angle $\epsilon$, wherein $\epsilon$ is less than or equal to $2\pi$, with the directional axes of the N microphones facing substantially radially outwards. Each of the N microphones have a substantially common directivity function $\Gamma(\theta)$ defining the directional response of the microphone, wherein $\theta=0$ is the directional axis, and the directivity function $\Gamma(\theta)$ is arranged such that a sound source in acoustical free field is effectively captured by no more than two consecutive microphones in the array. By arranging the directivity function in this manner crosstalk between non-adjacent microphones can be minimized, which has been shown to improve auditory localization performance.

19 Claims, 6 Drawing Sheets

(56) References Cited

OTHER PUBLICATIONS

Stereo Microphone Techniques . . . Are the Purists Wrong?, Lipshitz, J. Audio Eng. Soc., vol. 34, No. 9, pp. 716-744, Sep. 1986.
Instantaneous Intensity, Heyser, 81st Audio Engineering Society Convention, pp. 1-10, Nov. 1986.
Ambisonics—An Overview, Furness, AES 8th International Conference, pp. 181-190, May 1990.
Spatial Sound-Field Reproduction by Wave-Field Synthesis, Boone et al., J. Audio Eng. Soc., vol. 43, No. 12, pp. 1003-1012, Dec. 1995.
Methods for the Subjective Assessment of Small Impairments in Audio Systems Including Multichannel Sound Systems, ITU Radiocommunication Assembly, Rec. ITU-R BS.1116-1 (1994-1997).
Virtual Sound Source Positioning Using Vector Base Amplitude Panning, Pulkki, J. Audio Eng. Soc., vol. 45, No. 6, pp. 456-466, Jun. 1997.
The precedence effect, Litovsky et al., J. Acoust. Soc. Am., vol. 106, No. 4, Pt. 1, pp. 1633-1654, Oct. 1999.
Higher order Ambisonic systems for the spatialisation of sound, Malham, ICMC Proceedings, pp. 484-487, 1999.
Perceptual Soundfield Reconstruction, Johnston et al., pp. 1-14, Jun. 2000.
A Unified Theory of Horizontal Holographic Sound Systems, Poletti, J. Audio Eng. Soc., vol. 48, No. 12, pp. 1155-1182, Dec. 2000.
Coherent Multichannel Emulation of Acoustic Spaces, Hall et al., AEW 28th International Conference, pp. 1-10, Jun. 2006.
Analysis of Root Displacement Interpolation Method for Tunable Allpass Fractional-Delay Filters, Hacihabiboğlu et al., IEEE Transactions on Signal Processing, vol. 55, No. 10, pp. 4896-4906, Oct. 2007.
Panoramic Recording and Reproduction of Multichannel Audio Using a Circular Microphone Array, Hacihabiboğlu et al., 2009 IEEE Workshop on Applications of Signal Processing to Audio and Acoustics, pp. 1-4, Oct. 2009.
Simulation of Directional Microphones in Digital Waveguide Mesh-Based Models of Room Acoustics, Hacihabiboğlu et al., IEEE Transactions on Audio, Speech, and Language Processing, vol. 18, No. 2, pp. 213-223, Feb. 2010.
Perceptual Evaluation of a Circularly Symmetric Microphone Array for Panoramic Recording of Audio, De Sena et al., Proc. of the 2nd International Symposium on Ambisonics and Spherical Acoustics, pp. 1-4, May 2010.
Design of a Circular Microphone Array for Panoramic Audio Recording and Reproduction: Array Radius, De Sena et al., Audio Engineering Society 128th Convention, pp. 1-9, May 2010.
Design of a Circular Microphone Array for Panoramic Audio Recording and Reproduction: Microphone Directivity, De Sena et al., Audio Engineering Society 128th Convention, pp. 1-11, May 2010.
Reverberation Algorithms, Gardner, in Applications of DSP to Audio and Acoustics, pp. 85-131, 1998.
Differential Microphone Arrays, G. Elko, in Audio Signal Processing, pp. 11-65, (no. date).

* cited by examiner

MICROPHONE ARRAY

TECHNICAL FIELD

The present invention relates to a microphone array.

BACKGROUND TO THE INVENTION AND PRIOR ART

Sound sources can be situated at any direction on the horizontal plane. A good surround sound system should therefore reproduce sources situated at different directions equally accurately. Commercially available multichannel systems usually employ uneven loudspeaker positions favouring the front direction, and the audio material to be played back over such systems is typically engineered heavily at the post-processing stages so as to provide a good localization and ambience perception. While satisfactory listener experience can be achieved most of the time, the perceptual consistency of the reproduced audio with the actual recording environment cannot be guaranteed and the reproduced sound field reflects the choices of the audio engineer rather than the properties of the actual recording venue.

There exist different audio reproduction systems based on the concept of reconstructing the sound field exactly. Ambisonics and wave-field synthesis (WFS) are two such systems. The former achieves perfect reconstruction only at a narrow listening area. The latter requires significant computational resources and a high number of channels and is thus not feasible in a domestic setting. A multichannel recording and reproduction system was proposed by Johnston and Lam (J. D. Johnston and Y. H. Lam, "Perceptual soundfield reconstruction," Presented at the AES 109th Convention, Los Angeles, USA, Preprint #2399, 22-25 September 2000) that overcomes these limitations in order to provide a panoramic listening experience to the listener in a wider listening area.

More particularly, the Johnston-Lam array comprised a circularly symmetric microphone array composed of five first-order microphones on the horizontal plane facing outwards and two superdirectional microphones facing up and down. The stated aim of the Johnston-Lam array was to accurately capture interaural cues of binaural hearing. The recorded audio could be played back with a corresponding loudspeaker array consisting of five equispaced loudspeakers on a circle to provide panoramic audio to the listeners. The signals recorded using up and down facing microphones were mixed to signals obtained with the horizontal microphones. The system was reported to provide very realistic spatial perception. In a later patent (U.S. Pat. No. 6,845,163B1 to Johnston and Wagner), the setup was generalised to having odd number of microphones on the horizontal plane. It was also suggested in the patent that the vertical microphones can be omitted from the system without much subjective degeneration in the reproduced sound field.

In the original proposal and also in the subsequent patent the directivity pattern of the individual array elements were selected so as to have a gain of 3 dB below the front direction gain at the look direction of the neighbouring microphone, and a zero at the next non-consecutive channel. For the original proposal which considered five channels on the horizontal plane this requirement corresponded to having a 3 dB decrease at 72° from a microphone axis, and a zero at 144°. The second-order microphone directivity which satisfies these design considerations is given in FIG. 2.

Whilst the Johnston array provides a measure of panoramic audio recording, improvements in panoramic audio recording, and particularly improved localisation, would be desirable.

SUMMARY OF THE INVENTION

Embodiments of the invention improve upon the prior art array by having more carefully defined directivity functions designed to meet two criteria, being firstly to minimise crosstalk between non-adjacent microphones in the array, and secondly to design the array response such that it approximates stereophonic panning curves that have been shown to provided for good auditory localisation.

One embodiment therefore provides a microphone array, comprising N microphones, wherein N is greater than or equal to 3. The microphones are substantially equiangularly arranged over a circular arc subtending an angle $\epsilon$, wherein $\epsilon$ is less than or equal to $2\pi$, with the directional axes of the N microphones facing substantially radially outwards. Each of the N microphones have a substantially common directivity function $\Gamma(\theta)$ defining the directional response of the microphone, wherein $\theta=0$ is the directional axis, and the directivity function $\Gamma(\theta)$ is arranged such that a sound source in acoustical free field is effectively captured by no more than two consecutive microphones in the array. By arranging the directivity function in this manner crosstalk between non-adjacent microphones can be minimised, which has been shown to improve auditory localisation performance.

Within the embodiment by "effectively captured" we mean that an incident sound wave is captured by only two adjacent microphones in the array at a level that when the effectively captured signal is reproduced it is significant to spatial auditory perception. It therefore follows that the signals captured by the remaining microphones other than the two microphones do not substantially influence the spatial auditory perception when reproduced.

More specifically, within the embodiment the directivity function may be arranged such that when a source in acoustical free field, situated at angle $\theta$, wherein $$\frac{\varepsilon m}{N} \le \theta \le \frac{\varepsilon(m+1)}{N},$$

with the angular separation between the microphones with respect to the origin of the circular arc being $\epsilon/N$, the sound source is effectively captured only by microphones m and m+1.

In numerical terms, effective capture by more than two microphones is prevented in one embodiment when the directivity function $\Gamma(\theta)$ is further arranged such it is at least 15 dB below the value at the directional axis ($\theta=0$), i.e.

$$20\log_{10}\left(\frac{\Gamma(0)}{\Gamma(\theta)}\right) \ge 15$$

for $$\theta > \frac{\varepsilon}{N}$$

and $$\theta < \frac{-\varepsilon}{N}$$

with the angular separation between the microphones with respect to the origin of the circular arc being $\epsilon/N$. In this regard, −15 dB is sufficient to prevent any signals captured below this level from contributing to the auditory spatial perception when the signals are reproduced, and hence effectively enforces the cross-talk criterion.

As discussed, the second criterion that is applied is that the array response should approximate stereophonic panning rules, which have been shown to take into account psycho-acoustic characteristics in providing good auditory localisation. Therefore, according to a second embodiment of the invention there is also provided a microphone array, comprising: N microphones, wherein N is greater than or equal to 3. The microphones are again substantially equiangularly arranged over a circular arc subtending an angle $\epsilon$, wherein $\epsilon$ is less than or equal to $2\pi$, with the directional axes of the N microphones facing substantially radially outwards, and the N microphones have a substantially common directivity function $\Gamma(\theta)$ defining the directional response of the microphone, wherein $\theta=0$ is the directional axis. In this second embodiment, however, the directivity function $\Gamma(\theta)$ is further arranged such that the array response approximates a stereophonic panning curve for sound sources in directions of incidence $\theta$ between adjacent microphones in the array. By so doing, the array response takes into account psycho-acoustic parameters such as inter channel level difference, and inter channel time delay, and a more accurate auditory localisation can be obtained.

In one embodiment the second criterion can be applied only over a particular range of the directivity function, and therefore the directivity function $\Gamma(\theta)$ is further arranged such that the array response approximates a stereophonic panning curve for directions of sound sources incident substantially in the range $$\frac{-\varepsilon}{N} \le \theta \le \frac{\varepsilon}{N}$$

with the angular separation between the microphones with respect to the origin of the circular arc being $\epsilon/N$. Outside this range other criteria, such as the cross-talk criterion, can be applied.

In one embodiment the stereophonic panning curve approximates an intensity panning curve. This takes into account inter channel intensity differences received at different microphones, and provides good auditory localisation. Two intensity panning curves may be approximated in embodiments of the invention, being either a tangent intensity panning curve, or a sine intensity panning curve. In such cases the directivity function $\Gamma(\theta)$ is substantially given by:

$$\Gamma(\theta) = \sqrt{\frac{T(\varepsilon/(2N)-\theta)}{1+T(\varepsilon/(2N)-\theta)}}$$

where:

$$T(\phi) = \left[\frac{\tan\phi + \tan(\phi_0/2)}{\tan(\phi_0/2) - \tan\phi}\right]^2$$

or $$T(\phi) = \left[\frac{\sin\phi + \sin(\phi_0/2)}{\sin(\phi_0/2) - \sin\phi}\right]^2$$

and where $$\phi_0 = \frac{\varepsilon}{N},$$

with the angular separation between the microphones with respect to the origin of the circular arc being $\epsilon/N$.

In another embodiment the array response approximates a stereophonic time-intensity panning curve. The stereophonic time-intensity curve relates inter-channel time delay ($\tau$) and channel intensity ratio to perceived auditory image position, and also provides for good auditory localisation, taking into account inter channel time delay as a well as inter channel intensity differences. In an embodiment the stereophonic time-intensity curve comprises functions $L(\tau)$ and $R(\tau)$ which are the inter-channel level differences with respect to inter-channel time delay that are necessary to pan a stereophonic image towards a left loudspeaker or a right loudspeaker of a pair of loudspeakers, respectively, and in one particular embodiment the stereophonic time-intensity curve comprises functions $L(\tau)$ and $R(\tau)$ as shown in FIG. 3.

In one particular embodiment that approximates a time-intensity panning curve the directivity function $\Gamma(\theta)$ is substantially given by $\Gamma(\theta)=g(\tau(\theta))$, where $\tau(\theta)$ is the inter-channel time delay (ICTD) due to a plane wave incident on the microphone array at an angle $\theta$, and where:

$$g(\tau) = \sqrt{\frac{K^2(\tau)}{K^2(\tau)+1}}$$

with $$K(\tau) = 10^{\frac{f(k_0;\tau)}{10}}$$

and $f(k_o;\tau)$ is a monotonic function of $\tau$, parameterized by $$k_0 = \frac{R(\tau_{max}) - L(-\tau_{max})}{2\tau_{max}};$$

where:

$$\tau_{max} = -2\frac{r_m}{c}\sin^2\left(\frac{\varepsilon}{2N}\right); \text{ and}$$

$$\tau(\theta) = 2\frac{r_m}{c}\sin\left(\frac{\varepsilon}{2N}\right)\sin\left(\theta - \frac{\varepsilon}{2N}\right)$$

for $$\frac{-\varepsilon}{N} \le \theta \le \frac{\varepsilon}{N},$$

where c is the speed of sound, $r_m$ is the radius of the microphone array with the angular separation between the microphones with respect to the origin of the circular arc being $\epsilon/N$. In one embodiment the monotonic function is linear, and is given by $f(k_0;\tau)=k_0\tau$.

In one embodiment of the invention there is three microphones. In other embodiments of the invention there may be more than three microphones, such as four microphones, five microphones, six microphones, or seven microphones. In other embodiments a higher number of microphones may be used.

The microphone arrays of the above noted embodiment are intended to be used with an N channel recording system, in order to synchronously record the signals captured by the microphones in the array. Therefore, one embodiment of the invention further provides a panoramic audio recording system comprising: a microphone array according to one of the previous embodiments, and an N channel audio recorder arranged to record synchronously the respective audio signals captured at each of the N microphones in the microphone array. The N channel recorder may be any suitable analogue or digital recorder, and may record on to any convenient storage medium. One embodiment of the invention provides that the signals are digitally captured and stored, for example by a computer running appropriate software.

CROSS-REFERENCES

This patent application is based on material in the following published papers, the entire contents of which are hereby incorporated herein by reference for all purposes:

Ref 1: Hacihabiboglu H, Cvetkovic Z, "Panoramic Recording and Reproduction of Multichannel Audio Using a Circular Microphone Array", 2009 IEEE Workshop on Applications of Signal Processing to Audio and Acoustics, Oct. 18-21 2009, New Paltz, N.Y.

Ref 2: De Sena, E et al, "Perceptual Evaluation of a Circularly Symmetric Microphone Array for Panoramic Recording of Audio", Proc of the 2$^{nd}$ International Symposium on Ambisonics and Spherical Acoustics, May 6-7 2010, Paris, France Ref 3: De Sena, E, et al, "Design of a Circular Microphone Array for Panoramic Audio Recording and Reproduction: Array Radius", AES 128$^{th}$ Convention, London, UK, May 22-25 2010

Ref 4: Hacihabiboglu, H, et al, "Design of a Circular Microphone Array for Panoramic Audio Recording and Reproduction: Microphone Directivity", AES 128$^{th}$ Convention, London, UK, May 22-25 2010

DESCRIPTION OF FIGURES

Features and advantages of embodiments of the present invention will become apparent from the following description of embodiment thereof, presented by way of example only, and by reference to the accompanying drawings, wherein like reference numerals refer to like parts, and wherein.

DESCRIPTION OF EMBODIMENTS

There follows a discussion of the analytic evaluation of circularly symmetric arrays, followed by a description of embodiments of the invention.

A stationary sound field can be represented as a sum of monochromatic plane waves with different amplitudes, frequencies, phases, and propagation directions. An objective analysis of the directional reproduction capabilities of multichannel audio systems is thus possible by analysing the response of the system for a single monochromatic plane wave. The analysis presented here follows this approach.

Figure 5:
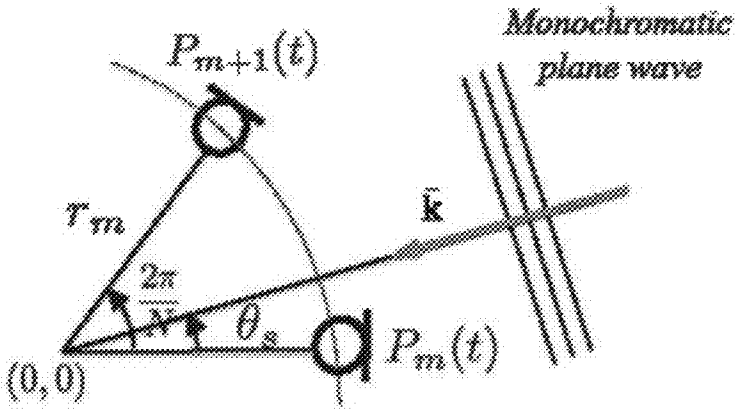
FIGS. 4 and 5 are diagrams illustrating the analysis of an incident plane wave.

The microphone array in embodiments of the present invention consists of an array of N directional microphones with the same directivity function, $\Gamma(f, \theta)$, positioned on a circle of radius $r_m$ at equal angular intervals with their acoustical axes pointing out (see FIG. 5). Directivity functions of real microphones are functions of both the angle of incidence and of frequency. However, for the purposes of analysis and design that the 'ideal' microphones in the hypothetical array are frequency independent (i.e. $\Gamma(f, \theta)=\Gamma(\theta)$ for all frequencies).

Let us consider a complex monochromatic plane wave of frequency $f_0$, incident from the horizontal direction, $\theta_s$. The signal recorded by the mth microphone is:

$$P_m(t) = A\Gamma_m(\theta_s)e^{jk_0[ct+r_a\cos(\theta_s-\frac{2\pi m}{N})]}$$

where A is the peak amplitude, $\Gamma_m(\theta_s)=\Gamma(2\pi m/N-\theta_s)$ is the sensitivity (i.e. directivity) of the microphone, $k_0=2\pi f_0/c$ is the wave number, $r_n$ is the radius of the microphone array and c is the sound speed.

Figure 4:
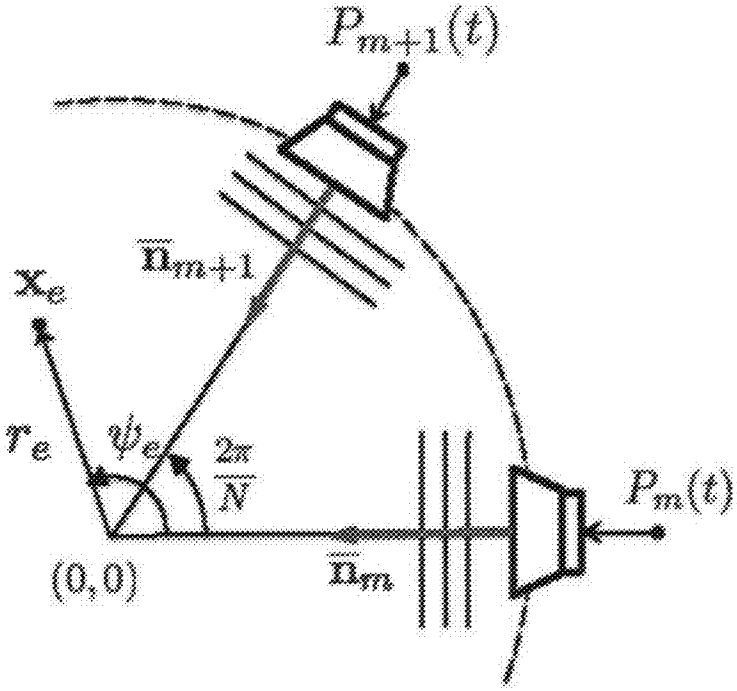

The reproduction setup consists of N angularly equispaced loudspeakers on a circle, as shown in FIG. 4. Each loudspeaker plays back the audio signal recorded by the microphone with the corresponding angle without any additional processing. Let us assume that the loudspeakers are positioned in the acoustic far-field and thus effectively behave as plane-wave sources. We can express the pressure component of the sound field at an arbitrary listening position, $x_e=r_e$ [cos $\psi_e$ sin $\psi_e$], within the listening area due to the loudspeaker m as:

$$p_m(x_e) = A\Gamma_m(\theta_s)e^{jk_0[ct+r_a\cos(\theta_s-\frac{2\pi m}{N})+r_a\cos(\psi_e-\frac{2\pi m}{N})]}$$

Here, $r_e=|x_e|$ is the radial distance from the centre of the circle defining the loudspeaker array, and $\psi_e$ denotes the angular positioning of the listening position.

The complex pressure and velocity components of the acoustical field in the listening area due to the loudspeaker array will be a sum of individual components due to these N loudspeakers:

$$p(x_e) = \sum_{m=1}^{N} p_m(x_e),$$

$$\overline{v}(x_e) = \frac{1}{\rho c}\sum_{k=1}^{N} p_k(r_l)\overline{n}_m.$$

where $\overline{n}_m$ is the unit vector co-directional with the acoustic axis of the loudspeaker m.

The product of pressure and (complex conjugate) velocity components is known as the complex intensity. Complex intensity is not time-dependent for a complex monochromatic plane wave as opposed to instantaneous intensity. The complex intensity, $I_c(x_e)$, can be expressed using the pressure and velocity components as:

$$I_c(x_e) = \frac{1}{2}p(x_e)\overline{v}^*(x_e),$$

-continued $$= \frac{1}{2\rho c}\sum_{k=1}^{N}\sum_{m=1}^{N} p_k(x_e)p_m^*(x_e)\bar{n}_m$$

The summand can be expressed as $$I_{c,km}(x_e)=A^2\gamma_{km}(\theta)e^{j2k_0d_{km}\sin\xi_{km}}\bar{n}_m$$

where $\gamma_{km}(\theta)=\Gamma_m(\theta)\Gamma_k(\theta)$ and, $$d_{km} = \sin\left[\frac{(k-m)\pi}{N}\right]\sqrt{r_a^2 + r_e^2 + 2r_a r_e\cos(\psi_e - \theta_s)},$$

$$\xi_{km} = \theta - \frac{(k+m)\pi}{N} + \tan^{-1}\left[\frac{r_e\sin(\psi_e - \theta_s)}{r_a + r_e\cos(\psi_e - \theta_s)}\right].$$

The real part of complex intensity, also known as "active intensity", can be used to investigate the directional properties of the reproduced sound field. Active intensity is co-directional with the propagation direction of a plane wave at a given location. The active intensity due to the combination of recording and reproduction systems is then given by:

$$I_{a,km}(x_e)=A^2\gamma_{km}(\theta_s)\cos(2k_0d_{km}\sin\xi_{km})\bar{n}_m.$$

The total active intensity is then:

$$I_a(x_e) = \sum_{k=1}^{N}\sum_{m=1}^{N} I_{a,km}(x_e)$$

It may be observed that the active intensity is related not only to the active intensities of individual loudspeakers, $I_{a,mm}(x_e)$, but also the cross-talk terms $I_{a,km}(x_e)$, $m\neq k$; occurring due to their interaction.

Correct reconstruction of the plane wave requires the reproduced active intensity $I_a(x_e)$ to be co-directional with the direction of wave propagation. The magnitude of active intensity determines the strength of the directional property of the reproduced sound field. Therefore, in order to reproduce the plane wave correctly active intensity should have a large magnitude and also be in the same direction as the propagation direction of the recorded plane wave. Therefore, the accuracy of the reproduction would benefit from the minimization (or elimination) of cross-talk terms.

In view of the above analysis, embodiments of the invention will now be described.

Figure 1:
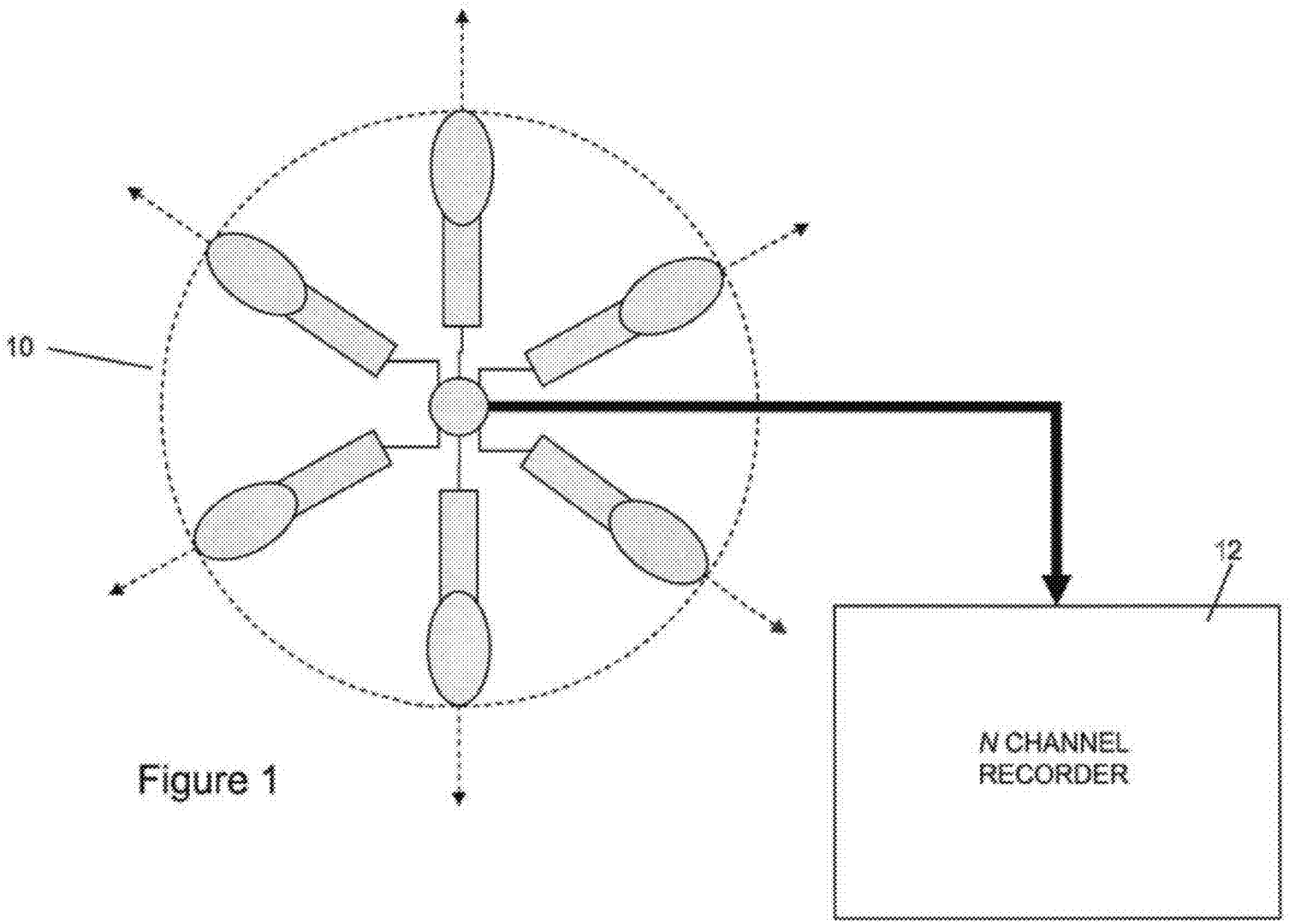
FIG. 1 is a diagram of a microphone array and recording apparatus of an embodiment of the invention.
Figure 10:
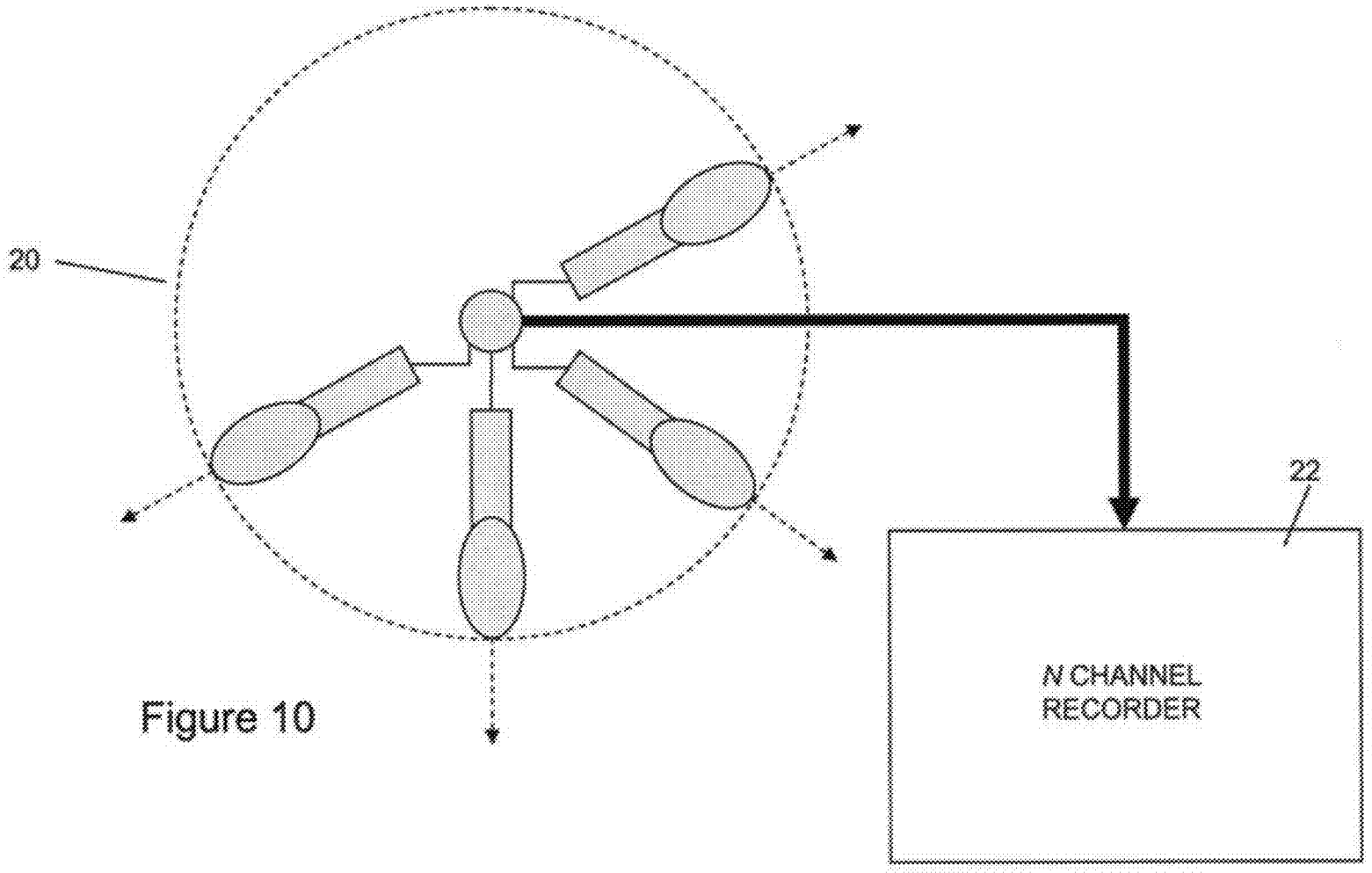
FIG. 10 is a diagram of a microphone array and recording apparatus of an embodiment of the invention.

Embodiments of the invention provide a microphone array 10 of the general arrangement shown in FIG. 1. Here, a plurality of N microphones are equiangularly arranged in a circle, with the acoustic axis of each microphone pointing radially outwards. In use the circle of microphones would be arranged in the horizontal plane. As many microphones as are available may be used, but a minimum of three are required, and in normal use little further benefit is obtained from having any more than seven, although higher numbers are possible, and there is no upper limit. Whilst in the main embodiments to be described here the arrangement of the microphones is equiangular around a whole circle, in other embodiments, for example where surround sound back channels are not required, the microphones may be equiangularly arranged about an arc or sector of a circle, subtending an angle $\epsilon$, as shown by the microphone array 20 in FIG. 10. More generally, therefore, embodiments of the invention include equiangular arrangements about any sector of a circle up to a complete circle.

With this in mind, within the below description of embodiments of the invention we describe the operational concepts and give the mathematical background generally for a circular array, i.e. where $\epsilon=2\pi$. It should be understood, however, that this is for convenience only, and that embodiments of the invention also cover arrangements where $\epsilon<2\pi$. For the purposes of understanding, in the various angular ranges given in the description below, as well as the mathematical derivations, it is usually possible, where the context so admits, to substitute $\epsilon$ for $2\pi$, and it should be apparent to the skilled person where such substitution is possible.

Figure 9:
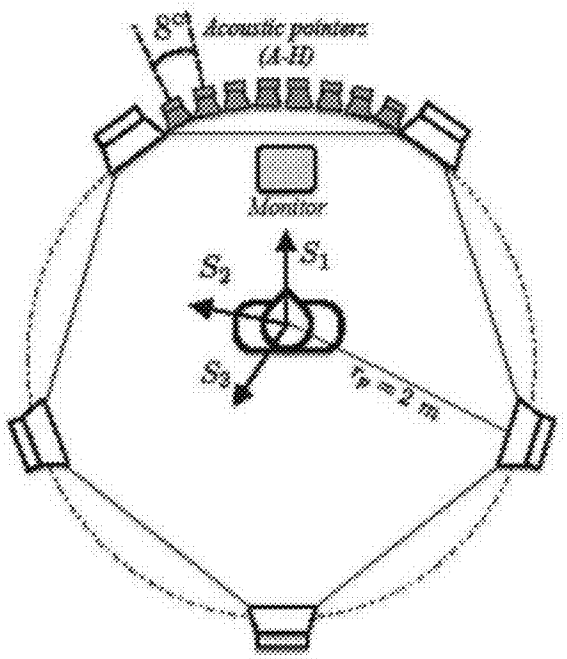
FIG. 9 is a diagram of a test loudspeaker setup used to evaluate the array.

Within the array 10 or 20 each microphone is connected to an N channel recording device 12 or 22, which is arranged to synchronously record the signals from each microphone. These signals can then later be synchronously reproduced using an appropriate corresponding loudspeaker setup, such as that shown in FIG. 9, for the circular array of FIG. 1. Generally, there will be a one to one correspondence between the number of loudspeakers and the number of microphones.

Thus far, the described array is similar to the prior art Johnston array. One main aspect where the arrays of the embodiments of the invention differ from the prior art is in the respective directivity functions at each microphone, which define how the microphone will pick up sound incident from different directions. By providing the directivity functions of the microphones in the array in accordance with embodiments of the invention, much improved and more accurate audio localisation results can be obtained by a listener when the recorded audio signal is reproduced by a corresponding loudspeaker setup.

More particularly, within the Johnston-Lam array the directivity functions of the microphones were simply cardioid-like patterns. Whilst such patterns provided 360 degree coverage, as well as overlapping patterns between adjacent microphones, no other considerations were taken into account in selecting the directivity function.

In contrast, within the embodiments of the present invention the directivity function of the microphones in the array is specifically designed to meet two main criteria. Firstly, as is apparent from the above analysis, at least two loudspeakers are required to reproduce the direction of a plane wave correctly around the optimal listening area (also known as the 'sweet spot' (i.e. $x_e=0$)). Therefore, the first criteria to be met by the directivity function used in the microphones is to be such that when the signals recorded by the microphones are reproduced only two loudspeakers are active for a sound source in the acoustical free field. The corollary of this in terms of the microphone directivity function is that only two microphones (the microphones corresponding in position to the loudspeakers to be active) should meaningfully and effectively capture the sound wave. For example, if the plane wave is incident from the direction, $\theta$, such that $$\frac{2\pi m}{N} \leq \theta \leq \frac{2\pi(m+1)}{N},$$

only the loudspeakers m and m+1 should be active (hence only microphones in and m+1 should effectively capture the plane wave). In order to achieve this, the cross-terms, $\gamma_{km}(\theta)$, for non-consecutive microphones, m and k, should be minimised. This requires designing directional microphones with the directivity function of the form:

$$\Gamma(\theta) = \sum_{i=0}^{M} a_k \cos^i(\theta),$$

for which

1. $\Gamma(\theta)=1$, and
2. $\Gamma(2m\pi/N)\approx 0$ for $m=2 \ldots N-2$.

In order to satisfy the second condition, each additional zero in the directivity function will require an increase in the order of directivity by one. Although there exists no comprehensive study of the audibility thresholds of reflections incident from behind the listener, cross-talk may be considered to be effectively zero if its level is at least 15 dB below the front direction sensitivity of the microphone. If this condition is satisfied, only two loudspeakers will be effectively active for any given source direction. In other words, the levels of the remaining loudspeakers will be too low to be audible. Therefore, in one embodiment of the invention, the directivity function is designed such that it is at least 15 dB lower than the level at the acoustic axis of a microphone at a position $2\pi/N$ and $-2\pi/N$ either side of the microphone for a circular array, or more generally $\epsilon/N$ and $-\epsilon/N$ for an array extending over sector $\epsilon$. In other embodiments, however, different attenuation levels may be used, the main criterion being that the microphone directivity functions are sufficiently narrow (when compared to the prior art) that no more than two microphones effectively capture an incident plane wave to the extent that they would significantly influence the perception of the direction of the sound wave to a human user when reproduced. This criterion is referred to herein as the cross-talk criterion, and effectively limits the angular range of the directivity function of each microphone to a range generally between $2\pi/N$ and $-2\pi/N$ either side of the acoustic axis for a circular array ($\epsilon/N$ and $-\epsilon/N$ for a sector array), although of course small variations either side of this range should also be encompassed by embodiments of the invention.

The second criterion to be applied to the directivity function is the shape of the directivity function within the range permitted by the cross-talk criterion. Within embodiments of the invention we build upon the body of work that has been undertaken in the field of stereophonic panning of acoustic images between two loudspeakers. This is a relatively well studied field, and there exists a great body of literature investigating different stereophonic recording techniques. The pros and cons of coincident, near-coincident, and noncoincident stereophonic recording have been studied previously, and the microphone array geometry of embodiments of the invention behaves like conjoined stereophonic microphone pairs if the cross-talk terms are eliminated. In other words both time and intensity differences will be present at each recorded channel.

Stereophonic panning rules typically take into account, in some cases heuristically, human psycho-acoustic characteristics in auditory image localisation. In particular, important parameters for auditory image localisation (i.e. for determining from which direction a sound appears to come from) are the respective channel levels, and respective timings. Hence, inter-channel level difference and inter-channel timing differences are very important in auditory image localisation, with small differences in each leading to potentially large errors in auditory image localisation.

Within embodiments of the invention two different stereophonic panning rules are used, to provide different embodiments. Within a first embodiment of the invention stereophonic intensity panning is used, whereas in a second embodiment of the invention a stereophonic time-intensity panning curve is used to derive the microphone directivity function. Each of these embodiments will be described in further detail next. Note that the first embodiment generally corresponds to the arrangement described in Ref 1 noted above, and the second embodiment generally corresponds to the arrangement described in Ref 4 noted above.

The aim of the proposed microphone array of the first embodiment is to have at most two loudspeakers active for a single plane wave. For example, if the plane wave is incident from an angle, $\theta$, such that $$\frac{2\pi k}{N} \le \theta \le \frac{2\pi(k+1)}{N}$$

for a circular array, only the loudspeakers k and k+1 should be effectively active. This constraint allows using stereophonic panning laws for designing the common microphone directivity pattern. As described, two rules are employed for this purpose: i) cross-terms, $\gamma_{mk}(\theta)$ for non-consecutive microphones, m and k, should be minimized, and ii) directivity function should approximate stereophonic panning laws for directions of incidence between consecutive microphones.

Assuming a smooth directivity function, $\Gamma(\theta)$, the cross-talk terms can be minimized by designing the directivity function to be zero (or effectively zero) at $\theta=2\pi k/N$ for $k\neq m$. In this way, a sound wave incident from an angle between two consecutive microphones will be reproduced by the two corresponding loudspeakers only. The values of the directivity function for $-2\pi/N\le\theta\le 2\pi/N$ can be designed based on the tangent panning law that is known to provide a good level of localization acuity in stereophonic reproduction. This allows each plane wave forming the sound field to be panned naturally without any additional processing. The stereophonic tangent panning law relates the gains of two loudspeakers to the target direction of the panned source and the angular separation between them such that:

$$\frac{\tan\phi}{\tan(\phi_0/2)} = \frac{g_1 - g_2}{g_1 + g_2}$$

where $0<\phi_0<\pi$ is the separation between the loudspeakers, $-\phi_0/2\le\phi\le\phi_0/2$ is the direction of the panned source defined from the midline of the two loudspeakers, $0\le g_1, g_2\le 1$ are the amplitude gains of the loudspeakers. Additionally sound power can be normalized such that $g_1^2+g_2^2=1$. These expressions can be simplified such that:

$$g_1 = \sqrt{\frac{T(\phi)}{1+T(\phi)}}.$$

where $$T(\phi) = \left[\frac{\tan\phi + \tan(\phi_0/2)}{\tan(\phi_0/2) - \tan\phi}\right]^2$$

For the proposed microphone array of the first embodiment with N elements, the angular separation between consecutive microphones/loudspeakers is $\phi_0=2\pi/N$ for a circular array, and the amplitude panning gain factors are $g_1=\Gamma(\pi/N-\phi)$ and $g_2=\Gamma(\pi/N+\phi)$. The directivity function can then be expressed as:

$$\Gamma(\theta)=\sqrt{\frac{T(\pi/N-\theta)}{1+T(\pi/N-\theta)}}$$

where $\Gamma(\theta)$ is $2\pi$-periodic.

A directional microphone with the prescribed directivity pattern can be realized using a differential microphone array consisting of a number of omnidirectional microphone elements. The design process involves obtaining coefficients, $a_m$, that determine the inter-element delays that should be used. In addition, filters for the equalization of the overall frequency response should be used. An Mth-order microphone directivity function is:

$$\tilde{\Gamma}(\theta)=\sum_{m=0}^{M}a_m[\cos(\theta)]^m$$

In order to obtain the microphone directivity that realizes the tangent panning function for the given azimuth range, and minimizes the cross-talk between non-consecutive channels, the coefficients, $a_m$, can be calculated by evaluating the directivity function at P discrete angles $0\leq\theta_p\leq 2\pi/N$ and setting the nulls of the directivity function at $\theta=2n\pi/N$, $n\neq k$. For odd number of channels another null at $\theta=\pi$ should also be imposed in order to reduce cross-talk further. The resulting set of linear equations can be expressed in matrix form as:

$$G=Ca$$

where $$C=\begin{bmatrix}1 & 1 & \dots & 1\\ 1 & \cos\theta_1 & \dots & \cos^M\theta_1\\ \vdots & \vdots & \ddots & \vdots\\ 1 & \cos\theta_P & \dots & \cos^M\theta_P\\ 1 & \cos\frac{2\pi}{N} & \dots & \cos^M\frac{2\pi}{N}\\ \vdots & \vdots & \ddots & \vdots\\ 1 & \cos\frac{2\pi(N-1)}{N} & \dots & \cos^M\frac{2\pi(N-1)}{N}\\ 1 & \cos\pi & \dots & \cos^M\pi\end{bmatrix}$$

$$G=[1\Gamma(\theta_1)\ \dots\ \Gamma(\theta_p)0\ \dots\ 0]^T,$$
$$a=[\,a_0\quad a_1\quad \dots\quad a_m\,]^T.$$

An optimal solution for the gain factors in the least-squares sense can be calculated using the left pseudoinverse $C^+=(C^TC)^{-1}C^T$ such that:

$$a=C^+G$$

Figure 8:
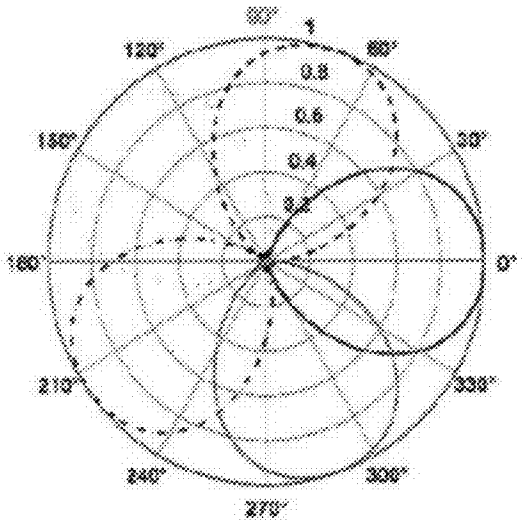

FIG. 8 shows the directivity functions of the microphones for a system with N=5 channels of the first embodiment. The directivity functions were obtained using the panning function calculated at p=10 points for M=5. The coefficients of the plotted directivity functions are $a_0=-0.0402$, $a_1=-0.0697$, $a_2=0.6771$, $a_3=1.2247$. $a_4=-0.1314$ and $a_5=-0.6622$.

Regarding the effectiveness of a microphone according to the first embodiment, section 4 of cross-reference 1 noted above (Hacihabiboglu H, Cvetkovic Z, "*Panoramic Recording and Reproduction of Multichannel Audio Using a Circular Microphone Array*", 2009 IEEE Workshop on Applications of Signal Processing to Audio and Acoustics, Oct. 18-21 2009, New Paltz, N.Y.), which is incorporated herein by reference, gives details of a test of the array. These test results show that the array provides good directional reproduction for a wide region. Listening tests also indicated that the proposed system provides excellent localization and a high level of realism. When compared to an omnidirectional directivity function and the cardioid function of the Johnston array, the directivity function provided in accordance with the first embodiment provides an improved and consistent directional reproduction in a wider listening area. In addition, the error is distributed more homogenously.

In a variant of the first embodiment, instead of using a tangent intensity panning rule of the form:

$$T(\phi)=\left[\frac{\tan\phi+\tan(\phi_0/2)}{\tan(\phi_0/2)-\tan\phi}\right]^2$$

as described above, a sine intensity panning rule of the form:

$$T(\phi)=\left[\frac{\sin\phi+\sin(\phi_0/2)}{\sin(\phi_0/2)-\sin\phi}\right]^2$$

may be used instead. The directivity function $\Gamma(\theta)$ remains in exactly the same form as presented above, but with the function $\Gamma(\theta)$ given by the above sine relationship, rather than the tangent relationship. The microphone directivity function may then be found an implemented in the same way as for the tangent intensity rule.

A second embodiment of the invention will now be described, which as noted corresponds to the arrangement described in Ref 4 noted above, the entire contents of which are incorporated herein by reference. Within the second embodiment a time-intensity stereophonic panning is used as the second criterion in the design of the directivity function, in addition to the cross talk criterion. The time-intensity panning relates inter-channel time delay and channel intensity ratio to perceived auditory image position.

More particularly, if the time delay is below a summing localisation threshold, it will be an important contributing factor in the formation of the perceived direction of the auditory event. From an audio engineering perspective, a practical approach to mapping time and intensity differences to the perceived direction of the auditory image was given by Franssen (N. V. Franssen, *Stereophony*. Eindhoven, the Netherlands: Philips Research Laboratories, 1964.).

Figure 3:
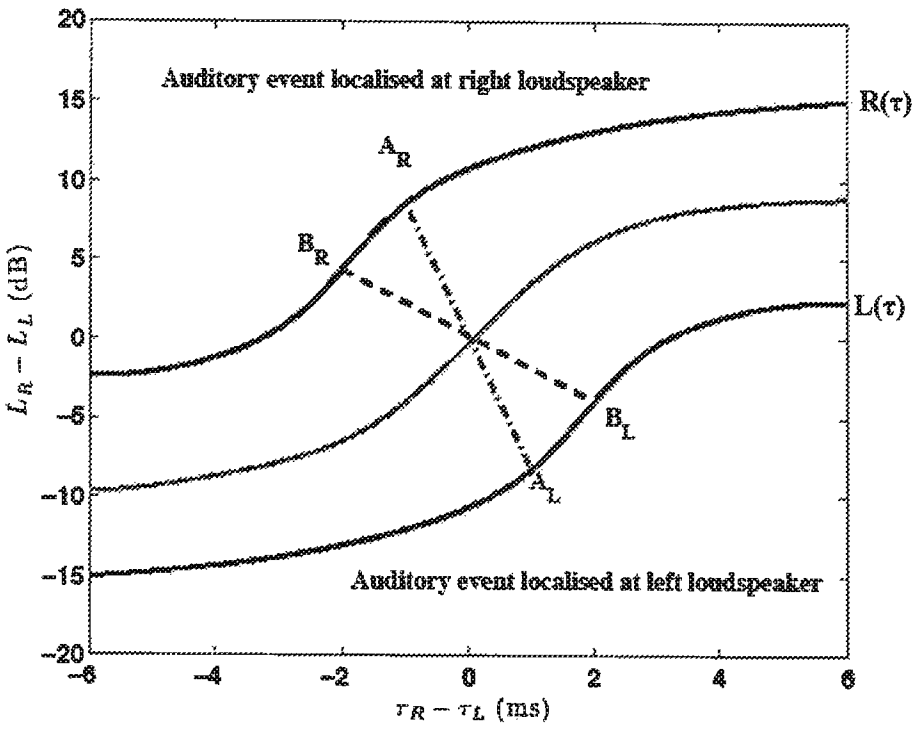
FIG. 3 is a graph of a pair of time-intensity stereophonic panning curves.
Figure 2:
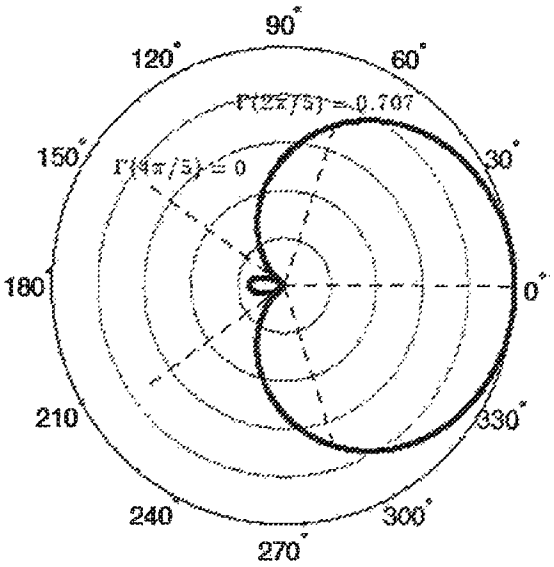
FIG. 2 is a plot of microphone directivity of the Johnston array.

FIG. 3 shows the stereophonic time-intensity panning curves adapted from Franssen. The curves represent the level difference between right and left channels in function of their time difference (delay) $\tau$. The upper curve, $R(\tau)$, represents the limit at which the auditory image is perceived to be located at the right loudspeaker. The lower curve, $L(\tau)$, represents the limit at which the auditory image is perceived at the left loudspeaker. Operating curves are defined in order to pan the stereophonic image between two loudspeakers with a given maximum interchannel delay. These curves are confined within the region between lines $R(\tau)$ and $L(\tau)$, pass through the origin and connect points $R(\tau_{max})$ and $L(\tau_{max})$, where $\tau_{max}$ is the maximal effective delay between two active adjacent channels. In the figure, two such operating curves (straight lines) are shown. The lines from $A_R$ to $A_L$, and $B_R$ to $B_L$ are the operating curves for time-intensity panning for a maximum interchannel delay of ±1 and ±2 ms, respectively.

Consider levels of left and right channels ($g_L$ and $g_R$) of a stereophonic setup. The time-intensity curves given in the figure represent the function:

$$\rho(\tau)=10\log[g_R(\tau)/g_L(\tau)]$$

where $\tau=\tau_r-\tau_l$ is the interchannel delay. If, the auditory image is perceived at the right loudspeaker. If $\rho(\tau)\geq R(\tau)$, the auditory image is perceived at the left loudspeaker. The operating curves (lines) then give the required loudspeaker level ratio as a function of the interchannel delay that will cause the auditory image to be panned between the loudspeakers. Additionally, total sound power should be constant i.e:

$$|g_R(\tau)|^2+|g_L(\tau)|^2=1$$

In this way, total sound level at the listening position will be constant independent of the direction of the sound source.

The operating line thus has a slope of:

$$k_0=\frac{R(\tau_{max})-L(-\tau_{max})}{2\tau_{max}}$$

where $\tau_{max}$ is a maximal effective delay between two channels.

The gain of the left (or right) channel can therefore be obtained simply as:

$$g(\tau)=\sqrt{\frac{K^2(\tau)}{K^2(\tau)+1}}$$

where $K(\tau)=10^{K_\sigma\tau/10}$, while the delay $\tau$ is a function of the angle of incidence of the sound wave.

Within the second embodiment, therefore, a time-intensity panning curve is used as the criterion in the directivity function design, in addition to the cross-talk criterion. In the second embodiment these two criteria are embodied as three conditions to be taken into account while designing the directivity function using time-intensity curves:

1. The designed directivity function when paired with the consecutive microphone channels of the recording array should result in a time-intensity panning for angles of incidence between two adjacent channels, 2. The directivity function, $\Gamma(\theta)$, should be at least 15 dB below its value for frontal direction for $\theta>2\pi/N$, and $\theta<2\pi/N$, and 3. The directivity function should be effectively zero for non-adjacent channels.

To provide a particular solution, let us consider a sound source in the acoustical far-field incident from a direction, $2m\pi/N\leq\theta_s\leq2(m+1)\pi/N$, between two consecutive channels of the circular microphone array. Let us also assume that the cross-talk terms are zero, so the source is effectively recorded by two microphones, m and m+1 only. The interchannel delay between these two channels depends on the direction of the source, $\theta_s$, (see FIG. 5) and can be calculated as:

$$\tau(\theta)=2\frac{r_m}{c}\sin\left(\frac{\pi}{N}\right)\sin\left(\theta-\frac{\pi}{N}\right)$$

The maximum effective delay between two adjacent channels (when signals at both channels are effectively non-zero) is:

$$\tau_{max}=-2\frac{r_m}{c}\sin^2\left(\frac{\pi}{N}\right)$$

A time-intensity palming operating line can be obtained as the straight line between the two maximal displacement points, having the slope:

$$k_0=\frac{R(\tau_{max})-L(-\tau_{max})}{2\tau_{max}}.$$

This operating line can then be used to obtain the corresponding gain which essentially is the sensitivity of the microphone for the given source direction.

In order to actually find the directivity function which meets the cross-talk criterion, and also the time-intensity panning curve as explained above, within the second embodiment the conditions stated above can be imposed analytically as a constrained linear least-squares optimisation problem on the coefficients $a_m$ in $$\Gamma(\theta)=\sum_{m=0}^{M}a_m[\cos(\theta)]^m,$$

as follows:

$$\min_a\|G_m a-\psi\|_2^2 \text{ such that } \begin{cases} G_t a\leq\beta \\ G_z a=0 \end{cases}$$

where $$G_m=[\cos^p\theta_{m,q}]\ q=0\ldots Q_m\ p=0\ldots M,$$

$$G_t=[\cos^p\theta_{t,q}]\ q=0\ldots Q_t\ p=0\ldots M,$$

$$a=[a_0a_1\ldots a_M]^T,$$

$$\psi=[g(\tau(\theta_{m,0}))\ldots g(\tau(\theta_{m,Q_m}))]^T,$$

$\beta$ is the maximum allowable crosstalk level between non-consecutive channels, $0\leq\theta_{m,q}\leq2\pi/N$, $2\pi/N<\theta_{t,q}\leq\pi$, and $\theta_{z,q}=2\pi i/N$, for i=2, . . . , N−2. Here, $\theta_{m,q}$ are the angles at which the difference between the directivity function and time-intensity panning gain is minimised, $\theta_{t,i}$ are the angles at which the cross-talk constraint is applied, and $\theta_{z,q}$ are the angles at which the directivity function is constrained to be zero.

Figure 6:
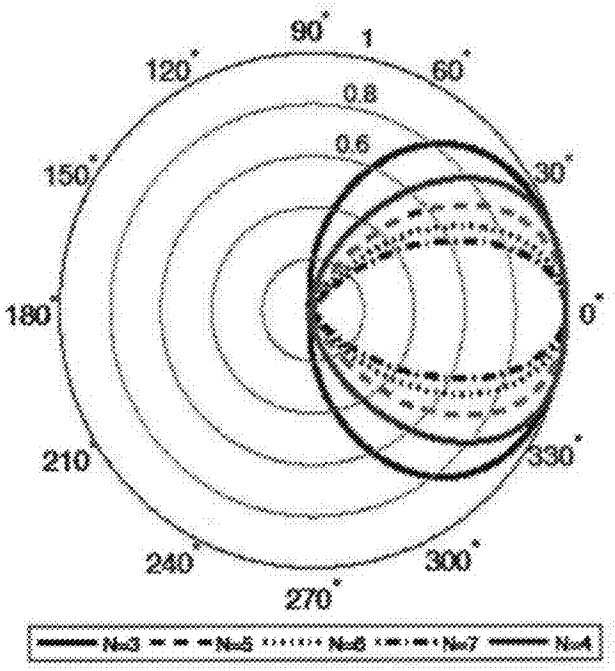
FIGS. 6, 7, and 8 are plots of microphone directivity in embodiments of the invention.

FIG. 6 shows the directivity pattern of the microphone thus obtained for $r_m$=15 cm, M=6, and N=5. The design objective due to time-intensity panning law is also overlaid on the directivity plot. It may be observed that a very good approximation to the design criteria can be obtained with a sixth-order design.

Figure 7:
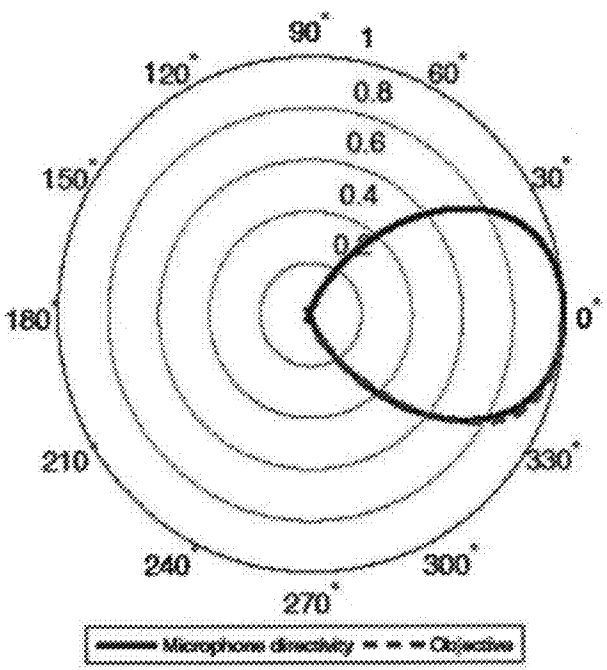

FIG. 7 shows the proposed directivity functions for different numbers of channels, N=3 to N=7 for $r_m$=15.5 cm for M=6. It may be observed that as the number of channels increases, a narrower beamwidth is required.

In terms of implementing the microphones with the directivity function thus found in the first and the second embodiments, each microphone in the array may be a differential microphone array, or an Eigenmike®, available from MH Acoustics LLC, of Summit, N.J. The Eignenmike is a professional quality microphone whose beam pattern (directivity function) can be very accurately controlled using a process of eigenbeamforming. By making each microphone in the array of the second embodiment an Eigenmike, then each microphone can very easily have its directivity function set to that calculated.

Regarding the performance of the microphone array of the second embodiment, section 5 of Reference 4 above (Hacihabiboglu, H, et al, "Design of a Circular Microphone Array for Panoramic Audio Recording and Reproduction: Microphone Directivity", AES 128$^{th}$ Convention, London, UK, May 22-25 2010), incorporated herein by reference, gives details of an evaluation that was undertaken to compare the TI panning arrangement with the tangent panning arrangement of the first embodiment, and the Johnston array of the prior art. The mean localisation errors and standard deviations for the tested directivities are given in Table 1 below. It may be observed from these statistics that both tanpan (first embodiment) and TI pan (second embodiment) directivities perform better than the Johnston/Lam directivity under the given experimental conditions.

TABLE 1

Experimental results

| Directivity | Mean error | Std. deviation |
|---|---|---|
| Johnston/Lam | 6.64° | 13.74° |
| Tanpan | 2.26° | 10.10° |
| TI pan | 4.44° | 10.80° |

One further factor that is relevant to both the described embodiments is the issue of the size of the array. In Reference 3 above, the entire contents of which are incorporated herein by reference, the inventors discuss the issue of array radius. The radius of the array should preferably be about the same size as the radius of a human head, although bigger arrays also produced good results. Therefore, whilst there is no upper or lower limit on the size of the array, it is thought that a radius in the range 10 to 30 cm is useful. In particular, the results suggested that a higher radius delivers a non optimal but larger sweet spot in listening position.

Various modifications, whether by way of addition, deletion, or substitution will be apparent to the intended reader, any and all of which are intended to be encompassed within the spirit and scope of the appended claims.

The invention claimed is:

1. A microphone array, comprising:

N microphones, wherein N is greater than or equal to 3, arranged over a circular arc subtending an angle $\epsilon$, wherein $\epsilon$ is less than or equal to $2\pi$, with the directional axes of the N microphones facing substantially radially outwards, the N microphones having respective non-cardioid directivity functions $\Gamma_m(\theta)$ defining the directional response thereof, wherein $\theta=0$ defines the directional axes;

wherein the directivity functions $\Gamma_m(\theta)$ are arranged such that for adjacent microphones in the array the directivity functions $\Gamma_m(\theta)$ thereof at least partially overlap, wherein a sound source in acoustical free field, situated at angle $\theta$, wherein $$\frac{\varepsilon m}{N} \le \theta \le \frac{\varepsilon(m+1)}{N},$$

is effectively captured by no more than two adjacent microphones m and m+1 in the array at a level that when the effectively captured signal is reproduced it is significant to spatial auditory perception; and wherein the directivity functions $\Gamma_m(\theta)$ are further arranged such that the array response approximates a stereophonic panning curve for the sound source in direction of incidence $\theta$ between adjacent microphones m and m+1 in the array.

2. A microphone array according to claim 1, wherein the directivity functions $\Gamma_m(\theta)$ are further arranged such they are at least 15 dB below the value at the directional axis ($\theta=0$), i.e.

$$20\log_{10}\left(\frac{\Gamma(0)}{\Gamma(\theta)}\right) \ge 15$$

for $$\theta > \frac{\varepsilon}{N} \text{ and } \theta < \frac{-\varepsilon}{N}.$$

3. A microphone array according to claim 1, wherein the stereophonic panning curve approximates an intensity panning curve.

4. A microphone array according to claim 3, wherein the directivity functions $\Gamma_m(\theta)$ are substantially given by:

$$\Gamma_m(\theta) = \sqrt{\frac{T(\varepsilon/(2N)-\theta)}{1+T(\varepsilon/(2N)-\theta)}}$$

where:

$$T(\phi) = \left[\frac{\tan\phi + \tan(\phi_0/2)}{\tan(\phi_0/2) - \tan\phi}\right]^2 \text{ or}$$

$$T(\phi) = \left[\frac{\sin\phi + \sin(\phi_0/2)}{\sin(\phi_0/2) - \sin\phi}\right]^2.$$

5. A microphone array according to claim 1, wherein the array response approximates a stereophonic time-intensity panning curve.

6. A microphone array according to claim 5, wherein the stereophonic time-intensity curves relate inter-channel time delays ($\tau$) and channel intensity ratio to perceived auditory image position.

7. A microphone array according to claim 6, wherein the stereophonic time-intensity curve comprises functions $L(\tau)$ and $R(\tau)$ which are the inter-channel level differences with respect to inter-channel time delay that are necessary to pan a stereophonic image towards a left loudspeaker or a right loudspeaker of a pair of loudspeakers, respectively.

8. A microphone array according to claim 7, wherein the directivity functions $\Gamma_m(\theta)$ are substantially given by $\Gamma_m(\theta)=g(\tau(\theta))$, where $\tau(\theta)$ is the inter-channel time delay (ICTD) due to a plane wave incident on the microphone array at an angle $\theta$, and where:

$$g(\tau)=\sqrt{\frac{K^2(\tau)}{K^2(\tau)+1}}\quad\text{with } K(\tau)=10^{\frac{f(k_0;\tau)}{10}}$$

and $f(k_0;\tau)$ is a monotonic function of $\tau$, parameterized by $$k_0=\frac{R(\tau_{max})-L(-\tau_{max})}{2\tau_{max}};$$

where:

$$\tau_{max}=-2\frac{r_m}{c}\sin^2\left(\frac{\varepsilon}{2N}\right);\text{ and}$$

$$\tau(\theta)=2\frac{r_m}{c}\sin\left(\frac{\varepsilon}{2N}\right)\sin\left(\theta-\frac{\varepsilon}{2N}\right)$$

for $$\frac{-\varepsilon}{N}\le\theta\le\frac{\varepsilon}{N},$$

where c is the speed of sound, $r_m$ is the radius of the microphone array, and $f(k_0;\tau)=k_0\tau$.

9. A panoramic audio recording system comprising:

a microphone array according to claim 1, and an N channel audio recorder arranged to record synchronously the respective audio signals captured at each of the N microphones in the microphone array.

10. A microphone array according to claim 1, wherein the N microphones are substantially equiangularly arranged over the circular arc subtending an angle $\epsilon$, the N microphones having a substantially common directivity function $\Gamma_m(\theta)$ defining the directional response thereof.

11. A method arranged to:

provide N non-cardioid directivity functions $\Gamma_m(\theta)$, wherein N is greater than or equal to 3, arranged over a circular arc subtending an angle $\epsilon$, wherein $\epsilon$ is less than or equal to $2\pi$, wherein $\theta=0$ defines the directional axes, wherein the N non-cardioid directivity functions $\Gamma_m(\theta)$ define respective directional acoustic responses;

wherein the directivity functions $\Gamma_m(\theta)$ are arranged such that adjacent directivity functions $\Gamma_m(\theta)$ at least partially overlap, wherein a sound source in acoustical free field, situated at angle $\theta$, wherein $$\frac{\varepsilon m}{N}\le\theta\le\frac{\varepsilon(m+1)}{N},$$

is effectively captured by no more than two adjacent directivity functions $\Gamma_m(\theta)$ m and m+1 at a level that when the effectively captured signal is reproduced it is significant to spatial auditory perception; and wherein the directional response of the directivity functions $\Gamma_m(\theta)$ are further arranged to approximate a stereophonic panning curve in direction of incidence $\theta$ between adjacent directivity functions $\Gamma_m(\theta)$ m and m+1.

12. A method according to claim 11, wherein the directivity functions $\Gamma_m(\theta)$ are further arranged such they are at least 15 dB below the value at the directional axis ($\theta=0$), i.e.

$$20\log_{10}\left(\frac{\Gamma(0)}{\Gamma(\theta)}\right)\ge 15$$

for $$\theta>\frac{\varepsilon}{N}\text{ and }\theta<\frac{-\varepsilon}{N}.$$

13. A method according to claim 11, wherein the stereophonic panning curve approximates an intensity panning curve.

14. A method according to claim 13, wherein the directivity functions $\Gamma_m(\theta)$ are substantially given by:

$$\Gamma_m(\theta)=\sqrt{\frac{T(\varepsilon/(2N)-\theta)}{1+T(\varepsilon/(2N)-\theta)}}$$

where:

$$T(\theta)=\left[\frac{\tan\phi+\tan(\phi_0/2)}{\tan(\phi_0/2)-\tan\phi}\right]^2\text{ or }T(\phi)=\left[\frac{\sin\phi+\sin(\phi_0/2)}{\sin(\phi_0/2)-\sin\phi}\right]^2.$$

15. A method according to claim 11, wherein the stereophonic panning curve approximates stereophonic time-intensity panning curves.

16. A method according to claim 15, wherein the stereophonic time-intensity curve relates inter-channel time delays ($\tau$) and channel intensity ratio to perceived auditory image position.

17. A method according to claim 16, wherein the stereophonic time-intensity curve comprises functions $L(\tau)$ and $R(\tau)$ which are the inter-channel level differences with respect to inter-channel time delay that are necessary to pan a stereophonic image towards a left loudspeaker or a right loudspeaker of a pair of loudspeakers, respectively.

18. A method according to claim 17, wherein the directivity functions $\Gamma_m(\theta)$ are substantially given by $\Gamma_m(\theta)=g(\tau(\theta))$, where $\tau(\theta)$ is the inter-channel time delay (ICTD) due to a plane wave incident at an angle $\theta$, and where:

$$g(\tau)=\sqrt{\frac{K^2(\tau)}{K^2(\tau)+1}}$$

$$\text{with } K(\tau)=10^{\frac{f(k_0;\tau)}{10}}$$

and $f(k_0;\tau)$ is a monotonic function of $\tau$, parameterized by $$k_0=\frac{R(\tau_{max})-L(-\tau_{max})}{2\tau_{max}};$$

where:

$$\tau_{max}=-2\frac{r_m}{c}\sin^2\left(\frac{\varepsilon}{2N}\right);\text{ and}$$

$$\tau(\theta)=2\frac{r_m}{c}\sin\left(\frac{\varepsilon}{2N}\right)\sin\left(\theta-\frac{\varepsilon}{2N}\right)$$

for $$\frac{-\varepsilon}{N} \leq \theta \leq \frac{\varepsilon}{N},$$

where c is the speed of sound, $r_m$ is the radius between the origins of opposing directivity functions, and $f(k_0;\tau)=k_0\tau$.

19. A method arranged to:

capture N signals, wherein N is greater than or equal to 3, arranged over a circular arc subtending an angle $\epsilon$, wherein $\epsilon$ is less than or equal to $2\pi$, with the directional axes of the N signals facing substantially radially inwards, wherein capturing the N signals includes providing non-cardioid directivity functions $\Gamma_m(\theta)$ defining the directional responses to the N signals, wherein $\theta=0$ is the directional axis;

wherein the directivity functions $\Gamma_m(\theta)$ are arranged such that for adjacent signals in the array of signals the directivity functions $\Gamma_m(\theta)$ thereof at least partially overlap, wherein a sound source in acoustical free field, situated at angle $\theta$, wherein $$\frac{\varepsilon m}{N} \leq \theta \leq \frac{\varepsilon(m+1)}{N},$$

relates to no more than two captured signals m and m+1 in the array at a level that when the effectively captured signal is reproduced it is significant to spatial auditory perception; and wherein the directivity functions $\Gamma_m(\theta)$ are further arranged such that they approximate a stereophonic panning curve in the direction of incidence $\theta$ between adjacent signals m and m+1.

* * * * *